US006831989B2

(12) United States Patent
Klein et al.

(10) Patent No.: US 6,831,989 B2
(45) Date of Patent: Dec. 14, 2004

(54) ELECTROACOUSTIC TRANSDUCER HAVING A MOVING COIL AND HAVING MOVABLE HOLDING ELEMENTS FOR THE CONNECTING LEADS OF THE MOVING COIL

(75) Inventors: Erich Klein, Himberg (AT); Ewald Frasl, Biedermannsdorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 128 days.

(21) Appl. No.: 10/262,797

(22) Filed: Oct. 2, 2002

(65) Prior Publication Data

US 2003/0068065 A1 Apr. 10, 2003

(30) Foreign Application Priority Data

Oct. 4, 2001 (EP) ..... 01890285

(51) Int. Cl.[7] ..... H04R 25/00
(52) U.S. Cl. ..... 381/409; 381/410
(58) Field of Search ..... 381/150, 162, 381/386, 394, 395, 396, 398, 400, 407, 409, 410, FOR 160, FOR 165; 439/492, 86

(56) References Cited

U.S. PATENT DOCUMENTS

| | | | | | |
|---|---|---|---|---|---|
| 2,906,828 | A | * | 9/1959 | Carbonneau | 381/409 |
| 5,091,958 | A | * | 2/1992 | Sakamoto et al. | 381/150 |
| 5,583,944 | A | * | 12/1996 | Morohoshi et al. | 381/400 |
| 5,838,809 | A | * | 11/1998 | Sato et al. | 381/409 |
| 6,526,152 | B2 | * | 2/2003 | Frasl | 381/409 |

FOREIGN PATENT DOCUMENTS

| | | | |
|---|---|---|---|
| WO | 0156329 A3 | 8/2001 | H04R/9/04 |
| WO | 0156329 A2 | 8/2001 | H04R/9/04 |

* cited by examiner

*Primary Examiner*—Curtis Kuntz
*Assistant Examiner*—Brian Ensey
(74) *Attorney, Agent, or Firm*—Peter Zawilski

(57) ABSTRACT

An electroacoustic transducer (1) having an oscillator coil (15) which has two connecting leads (27, 28) is equipped with at least one retaining element (33, 34) for each connecting lead (27, 28), each retaining element (33, 34) being connected to a stationary component (2) of the transducer (1) and being held movable in relation to said stationary component (2), while said stationary component (2) borders a holding space (39, 40) through which a connecting lead (27, 28) being passed through.

4 Claims, 2 Drawing Sheets

ELECTROACOUSTIC TRANSDUCER HAVING A MOVING COIL AND HAVING MOVABLE HOLDING ELEMENTS FOR THE CONNECTING LEADS OF THE MOVING COIL

The invention relates to an electroacoustic transducer having stationary components, of which one component is formed by a membrane holder for holding a membrane, and having a magnet system, and having a membrane which has a membrane area connected to the membrane holder, and having an oscillator coil for interaction with the magnet system, said oscillator coil having a hollow cylindrical coil body and two connecting leads which each have a free end connected electrically and mechanically to a stationary connection contact of the transducer, wherein at least one retaining element assigned to the relevant connecting lead is provided for each connecting lead.

An electroacoustic transducer of this type is known from the patent WO 01/56329 A2. In the known transducer, each retaining element preferably comprises two plastic films held together by means of an adhesive layer comprising a non-curing adhesive, so that a retaining element is realized which is elastically deformable parallel to the direction of the membrane's membrane axis. In the known transducer, each retaining element is designed in sheet or strip form and here attached at one end to a stationary component of the known transducer, namely to a membrane holder, with the connecting lead in question being attached in the area of the other end of each retaining element, namely by means of a bonded joint. Satisfactory results may be achieved with the above-described embodiment of the known transducer, but nevertheless this known embodiment is still capable of improvement, because the realization of this known embodiment requires relatively high production costs; this is because the realization of the bonded joint between a connecting lead and a retaining element requires a separate production stage. In addition, it was found that in many applications of the known transducer every bonded joint between a connecting lead and a retaining element may represent a restriction of the mobility of the connecting lead. In addition, the problem may occur that with a particularly long working life the bonded joint between a connecting lead and a retaining element is subject to excessive aging, which could result in damage to or the elimination of the bonded joint.

It is an object of the invention to avoid the problems described above and to create a further improved electroacoustic transducer in which the above-mentioned object is achieved at little expense and by simple means.

To achieve the object described above, an electroacoustic transducer according to the invention is provided with features according to the invention, so that an electroacoustic transducer according to the invention may be characterized as follows:

An electroacoustic transducer having stationary components, of which one component is formed by a membrane holder for holding a membrane, and having a magnet system, and having a membrane designed to be oscillated in parallel to a membrane axis and having a membrane area which is connected to the membrane holder, and having an oscillator coil which is designed for interaction with the magnet system and which has a hollow cylindrical body and two connecting leads, each free end of the connecting leads being electrically and mechanically connected to a stationary connection contact of the transducer, and having at least one retaining element for each connecting lead of the oscillator coil, wherein each retaining element being connected to a stationary component of the transducer and being held movable in relation to said stationary component and wherein each retaining element together with said stationary component bordering a holding space through which a connecting lead is being passed through.

The provision of the features according to the invention enables the realization in a structurally simple and space-saving way and for an only very low additional expenditure an electroacoustic transducer, in which, even with relatively long oscillator coil connecting leads, a good compromise is achieved between the best possible holding of the connecting leads on the one hand and a connecting lead mobility which is as unrestricted as possible on the other hand. In the transducer according to the invention, every retaining element and the stationary component of the transducer bearing the retaining element defines and borders a holding space for a connecting lead, with it advantageously being possible to select the dimensions of the holding space such that the connecting lead in question is securely held in a positive connection on the one hand and the connecting lead in question is given enough freedom of movement on the other so that no detrimental restriction of the mobility of the connecting lead occurs. Another advantage is provided with the transducer according to the invention in that the creation of the holding joint between a connecting piece and a retaining element during manufacture of the transducer may be performed automatically by introducing the connecting lead in question into the holding space between the stationary component and the retaining element and without the need to produce a bonded joint.

In an electroacoustic transducer according to the invention, each retaining element may be formed by a slide which may be moved between two positions on said stationary component of the transducer, with it being possible to set the two positions of the slide by means of snap-in joints or with it being possible for the slide to be loaded with a spring which loads the slide in the direction towards an operating position in which the slide is used to hold a connecting lead. However, it has been found to be advantageous if each retaining element is formed by a pivotable mounted lever. This is very advantageous with regard to achieving the simplest possible embodiment.

In the context described above, it has been found to be particularly advantageous if each lever provided as a retaining element is hook-shaped. This ensures the particularly reliable retention of a connecting lead with a hook-shaped retaining element.

In a transducer according to the invention with a retaining element designed as a lever, it has been found to be particularly advantageous if each lever provided as a retaining element is realized in one piece with the said stationary component. This object has been found to be particularly advantageous with regard to a particularly simple structural embodiment and with regard to ease of manufacture.

The aspects described above and other aspects of the invention may be derived from the embodiment described below and are described with reference to this embodiment.

The invention will be further described with reference to embodiments shown the drawings to which, however, the invention is not restricted.

Figure 1:
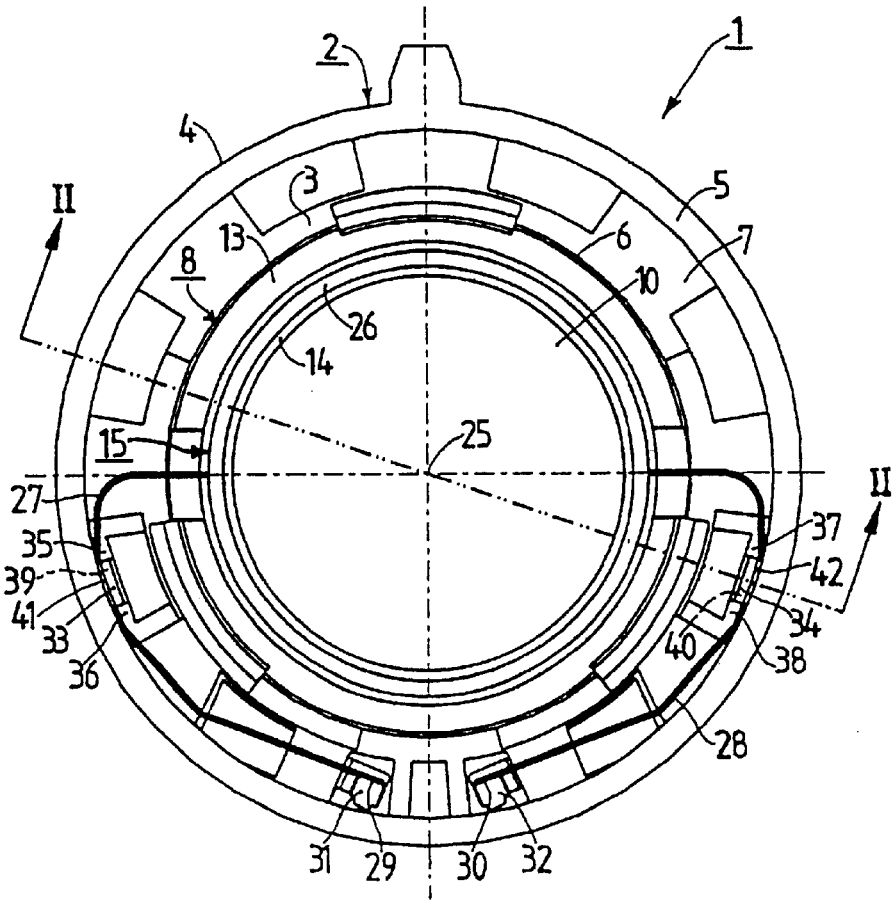
FIG. 1 is a plan view on an enlarged scale of an electroacoustic transducer according to one embodiment of the invention.
Figure 2:
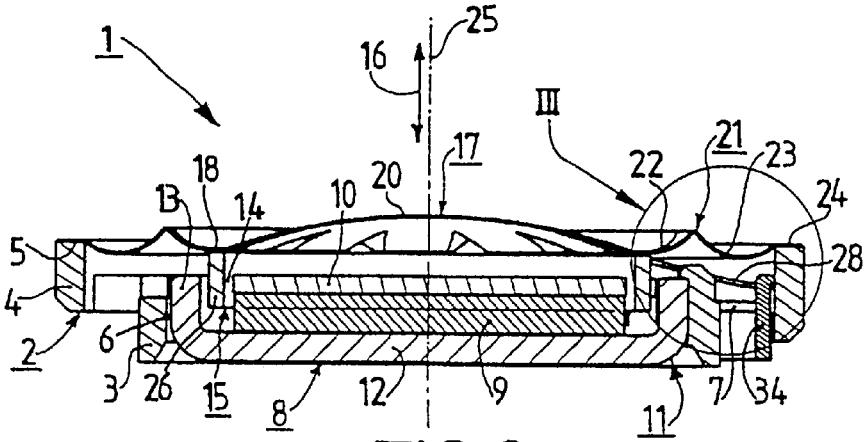
FIG. 2 shows the transducer of FIG. 1 in a cross-a section taken on the line II—II in FIG. 1.

FIGS. 1 to 4 show all or part of an electroacoustic transducer 1, which will be referred to hereinafter as the transducer 1 for short. The transducer 1 has an essentially pot-shaped housing 2 comprising an essentially hollow-cylindrical housing interior 3 and a similarly essentially hollow-cylindrical housing exterior 4, said housing exterior being provided with a limiting surface 5 on its end facing away from the housing interior 3. A circular cylindrical passage 6 is provided in the housing interior 3. The housing interior 3 and the housing exterior 4 are connected to each other via several bars 7.

The transducer 1 is provided with a magnet system 8. The magnet system 8 comprises a magnet 9 and a pole plate 10 and a pot 11, which is frequently also described as an external pot and which comprises a pot bottom 12 and a hollow cylindrical pot part 13. The hollow-cylindrical pot part 13 is held in the passage 6 in the housing interior 3.

An air gap 14 is formed in the magnet system 8 between the circumferential limiting surface of the pole plate 10 and the end area of the hollow cylindrical pot part 13 facing the pole plate 10. The air gap 14 accommodates part of an oscillator coil 15 of the transducer 1. The oscillator coil 15 is oscillated by means of the magnet system 8 essentially parallel to a direction of oscillation indicated in FIG. 1 by a double arrow 16. The oscillator coil 15 is connected to a membrane 17 in the transducer 1. The membrane 17 is not shown in FIGS. 1 and 4 in order to enable the components of the transducer 1 behind and under the membrane 17 to be visible.

To connect the oscillator coil 15 to the membrane 17, the membrane 17 is provided with a ring-shaped connecting area 18. The oscillator coil 15 is connected to the connecting area 18 by means of a bonded joint 19. In addition to the ring-shaped connecting area 18, the membrane 17 also has an internal area 20 lying within the connecting area 18 and running convexly in relation to the acoustic clearance 20 and an external area 21 lying outside the connecting area 18. Here, the external area 21 comprises a first external area section 22 running convexly in relation to the acoustic clearance and emerging from the connecting area 18 and a second external area section 23 emerging from the first external area 22 and also running convexly in relation to the acoustic clearance. The second external area 23 passes into a ring-shaped flat membrane area 24, which forms an edge area 24 of the membrane 17.

The edge area 24 connects the membrane 17 in the area of the limiting surface 5 of the housing exterior 4 to the housing 2 of the transducer 1, i.e. by means of a bonded joint not shown in the diagrams. On the transducer 1, the membrane 17 is therefore retained by means of the housing 2, so that the housing 2 also forms a membrane holder.

The membrane 17 is designed to be oscillatory parallel to a membrane axis 25, which also forms a transducer axis of the transducer 1. In order to be able to oscillate the membrane 17—as already mentioned—the oscillator coil 15 is connected to the membrane 17.

The oscillator coil 15, which is designed to interact with the magnet system 8 and is partially located in the air gap 14 of the magnet system 8 for this purpose, has a hollow cylindrical coil body 26 which is wound from a magnetic wire. In addition, the oscillator coil 15 has two connecting leads 27 and 28. The two connecting leads 27 and 28 are formed by the end sections of the magnet wire, from which the oscillator coil 15 is formed., The free ends 29 and 30 of the two connecting leads 27 and 28 are connected to respective stationary connection contacts 31 and 32. The two connection contacts 31 and 32 are each formed from a bent contact spring. The two contact springs are held on the housing 2. The connection of each free end 29 and 30 to the stationary connection contact 31 and 32 in question is both of an electrical and a mechanical nature, i.e. these connections are formed by soldered connections.

In the transducer 1, a retaining element 33 or 34 is advantageously provided for each connecting lead 27 and 28 of the oscillator coil 15. Here, both retaining elements 33 and 34 are connected to the housing 2 of the transducer 1, i.e. to a stationary component of the transducer 1. In this case, this connection is realized by each retaining element 33 or 34 being formed in one piece with said stationary component of the transducer 1, i.e. with the housing 2 of the transducer 1.

Each retaining element 33 or 34 is held adjustably in relation to the housing 2 of the transducer 1, which in this case achieves the object that each retaining element 33 or 34 is formed by a swivel-mounted lever, with each lever provided as a retaining element 33 or 34 having a hooked shape. For the swivel-mounting of each lever provided as a retaining element 33 or 34, two bearing studs 35 and 36 or 37 and 38 protrude from the side of each lever 33 or 34, as is clearly shown for the retaining element 34 in FIG. 4. The two bearing studs 35, 36 or 37, 38 define the swivel axis for the retaining element 33 or 34 in question.

Figure 3:
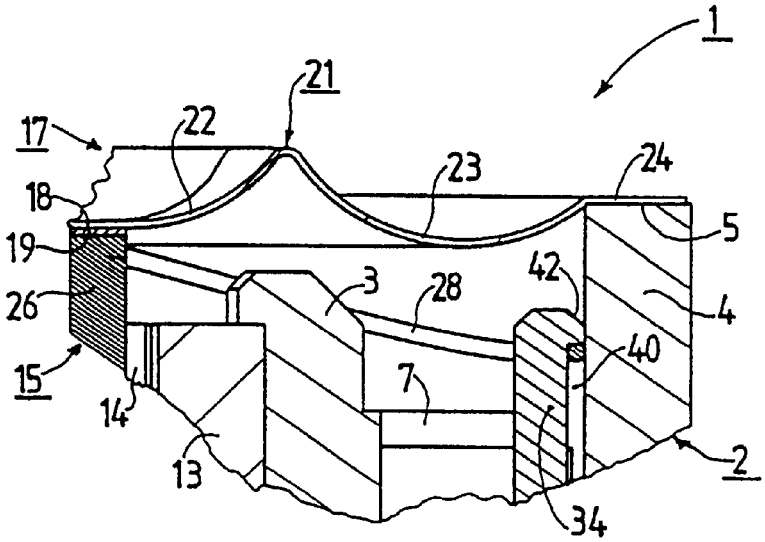
FIG. 3 shows a detail of the transducer of FIGS. 1 and 2 taken on the circular line III in FIG. 2 on a larger scale than in FIG. 2.
Figure 4:
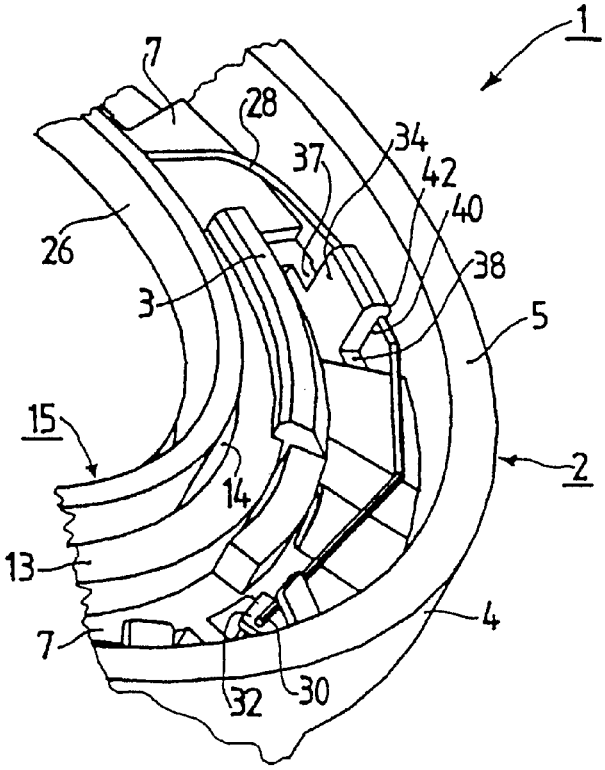
FIG. 4 shows in an oblique view from above the detail of the transducer of FIGS. 1 and 2 shown in FIG. 3.

As may be seen particularly clearly in FIG. 3, every retaining element 33 or 34 together with said stationary component of the transducer 1, i.e. with the housing 2 of the transducer 1, delimits a holding space 39 or 40, through which a connecting lead 27 or 28 is passed. As may be seen for the holding space 40 in FIG. 3, each of the two holding spaces 39 and 40 lies between the housing exterior 4 of the housing 2 and the retaining element 33 or 34 in question.

In the transducer 1, it is advantageously ensured that each connecting lead 27 or 28 in the holding space 39 or 40 formed by a retaining element 33 or 34, and the housing exterior 4 is on the one hand securely held in a positive connection and but on the other has sufficient freedom of motion parallel to the direction of the membrane axis 25 to ensure there is no detrimental restriction of the mobility of the connecting lead 27 or 28 in question.

Another advantage of the transducer 1 consists in the fact that each connecting lead 27 or 28 may be introduced in a simple and above all mechanized way into the holding space 39 or 40 in question, i.e. in that each of the two connecting leads 27 and 28 is pushed along an inlet bevel 41 or 42 provided on the retaining element 33 or 34 in question outwards between the housing exterior 4 and the retaining element 33 or 34 in question, during which an adjusting device (not shown) effects a pivoting (swiveling) of the retaining element 33 or 34 in question with its hook-shaped end away from the housing exterior 4 until the connecting lead in question 27 or 28 reaches the holding space 39 or 40 provided for it, after which each retaining element 33 or 34 is released by the adjusting device and then returns automatically to its original position in which it rests with its hook-shaped end snugly on the housing exterior 4 and in this way ensures that the connecting lead 27 or 28 contained in the holding space 39 or 40 in question is held secure. In the transducer 1 described above, the two retaining elements 33 and 34 are connected to the housing 2 of the transducer 1. It is also possible to connect retaining elements to other stationary components of a transducer, for example to a stationary component of the magnet system, for example an external pot in the magnet system, such as the one also provided with the transducer 1 described above.

In the transducer 1 described above, the two retaining elements 33 and 34 are connected to the housing 2 of the transducer 1 in one piece. However, such retaining elements 33 and 34 may alternatively be formed by separate components in relation to the housing 2, which are connected to the housing 2 in that the bearing studs 35 and 36 or 37 and 38 of these retaining elements 33 and 34 formed from separate components are used in accommodation chambers provided for them in the housing 2 and held secure therein by interference fit.

It is also possible to provide two or three or more retaining elements for each connecting lead 27 or 28, if this is necessary and useful.

However, lever-type retaining elements do not necessarily have to be of a hook-shaped design, but may also run straight with no hook-shaped bending and with a stationary component of the transducer delimiting a holding space which tapers in a wedge shape.

Instead of having a pivot-lever design, retaining elements may also have a sliding carriage design.

What is claimed is:

1. An electroacoustic transducer (1) having stationary components (2, 8, 31, 32, 33, 34), of which one component (2) is formed by a membrane holder (2) for holding a membrane (17), and having a magnet system (8), and having a membrane (17) designed to be oscillated in parallel to a membrane axis (25) and having a membrane area (24) which is connected to the membrane holder (2), and having an oscillator coil (15) which is designed for interaction with the magnet system (8) and which has a hollow cylindrical coil body (26) and two connecting leads (27, 28), each free end (29, 30), of the connecting leads (27, 28) being connected electrically and mechanically to a stationary connection contact (31, 32) of the transducer (1), and having at least one retaining element (36, 37) for each connecting lead (27, 28) of the oscillator coil (15), wherein each retaining element (33, 34) being connected to a stationary component (2) of the transducer (1) and being held movable in relation to the said stationary component (2) and wherein each retaining element (33, 34) together with said stationary component (2) bordering a holding space (39, 40), are located underneath the membrane (17) near the membrane area (24) through which a connecting lead (27,28) being passed through.

2. An electroacoustic transducer (1) as claimed in claim 1, wherein each retaining element (33, 34) is formed by a pivotable mounted lever.

3. An electroacoustic transducer (1) as claimed in claim 2, wherein each lever provided as a retaining element (33, 34) has a book-shaped design.

4. An electroacoustic transducer (1) as claimed in claim 2, wherein each lever provided as a retaining element (33, 34) is realized in one piece with said stationary component.

* * * * *